US009240636B2

(12) United States Patent
Youtsey

(10) Patent No.: US 9,240,636 B2
(45) Date of Patent: Jan. 19, 2016

(54) COAXIAL CABLE CONNECTOR HAVING A COUPLING NUT AND A CONDUCTIVE INSERT WITH A FLANGE

(75) Inventor: Timothy Lee Youtsey, Scottsdale, AZ (US)

(73) Assignee: PCT International, Inc., Mesa, AZ (US)

( * ) Notice: Subject to any disclaimer, the term of this patent is extended or adjusted under 35 U.S.C. 154(b) by 0 days.

(21) Appl. No.: 14/118,198

(22) PCT Filed: May 2, 2012

(86) PCT No.: PCT/US2012/036065

§ 371 (c)(1),
(2), (4) Date: Apr. 7, 2014

(87) PCT Pub. No.: WO2012/158343

PCT Pub. Date: Nov. 22, 2012

(65) Prior Publication Data

US 2014/0220811 A1 Aug. 7, 2014

Related U.S. Application Data

(63) Continuation of application No. 13/111,807, filed on May 19, 2011, now abandoned.

(51) Int. Cl.
*H01R 9/05* (2006.01)
*H01R 13/622* (2006.01)
(Continued)

(52) U.S. Cl.
CPC ..... *H01R 9/0521* (2013.01); *H01R 9/0527* (2013.01); *H01R 13/622* (2013.01); *H01R 13/639* (2013.01); *H01R 24/40* (2013.01); *H01R 2103/00* (2013.01)

(58) Field of Classification Search
CPC ..... H01R 13/62; H01R 13/629; H01R 9/05; H01R 9/0521; H01R 9/0527
USPC ..... 439/578–585, 320–323
See application file for complete search history.

(56) References Cited

U.S. PATENT DOCUMENTS 2,233,216 A 2/1941 Frederick
2,304,711 A 12/1942 Shenton
(Continued)

FOREIGN PATENT DOCUMENTS

CN 201117964 Y 9/2008
DE 3111832 10/1982
(Continued)

OTHER PUBLICATIONS

"F-type connectors", ShowMe Cables, dated 2007 and printed on Jul. 9, 2008, 1 page, located at: http://www.showmecables.com/F-Type-Connectors.html.
(Continued)

*Primary Examiner* — Chandrika Prasad
(74) *Attorney, Agent, or Firm* — Perkins Coie LLP

(57) ABSTRACT

A male coaxial connector of the present invention comprises a conductive insert and a coupling nut. The conductive insert has a front end with an annular flange. The coupling nut includes an inner surface defining a bore, wherein the bore at least partially surrounds the conductive insert and is configured to receive a provided female coaxial connector. The coupling nut further includes a locking member extending from its inner surface. The male connector further comprises a torque washer formed from fiber-reinforced rubber and disposed between the flange of the conductive insert and the locking member. When the coupling nut engages a female coaxial connector, the locking member and the torque washer are compressed against the flange of the insert. The compressed locking member and the compressed torque washer each maintain a tension force between the male and female connectors to help prevent separation of the male and female connectors. The male coaxial connector can be configured to be coupled to an end of the coaxial cable by, for example, crimping or compression.

54 Claims, 9 Drawing Sheets

(51) Int. Cl.

| | |
|---|---|
| ***H01R 13/639*** | (2006.01) |
| *H01R 24/40* | (2011.01) |
| *H01R 103/00* | (2006.01) |

(56) References Cited

U.S. PATENT DOCUMENTS

| | | | | |
|---|---|---|---|---|
| D140,861 | S | | 4/1945 | Conlan |
| 3,274,447 | A | | 9/1966 | Nelson |
| 3,275,737 | A | | 9/1966 | Caller |
| 3,344,227 | A | | 9/1967 | Gilmartin et al. |
| 3,366,920 | A | | 1/1968 | Clair et al. |
| 3,390,374 | A | | 6/1968 | Forney, Jr. |
| 3,489,988 | A | | 1/1970 | Carnaghan |
| 3,517,375 | A | | 6/1970 | Mancini |
| 3,544,705 | A | | 12/1970 | Winston |
| 3,601,776 | A | | 8/1971 | Curl |
| 3,609,651 | A | | 9/1971 | Sladek et al. |
| 3,653,689 | A | | 4/1972 | Legris et al. |
| 3,671,922 | A | | 6/1972 | Zerlin et al. |
| 3,708,781 | A | | 1/1973 | Trompeter |
| 3,740,453 | A | | 6/1973 | Callaghan et al. |
| 3,746,931 | A | | 7/1973 | Muranaka et al. |
| 3,777,298 | A | | 12/1973 | Newman |
| 3,778,535 | A | | 12/1973 | Forney |
| 3,836,700 | A | | 9/1974 | Niemeyer |
| 3,863,111 | A | | 1/1975 | Martzloff |
| 4,159,859 | A | | 7/1979 | Shemtov |
| 4,225,162 | A | | 9/1980 | Dola |
| 4,307,926 | A | | 12/1981 | Smith |
| 4,377,320 | A | | 3/1983 | Lathrop et al. |
| 4,400,050 | A | | 8/1983 | Hayward |
| 4,408,822 | A | | 10/1983 | Nikitas |
| 4,439,632 | A | | 3/1984 | Aloisio, Jr. et al. |
| 4,509,090 | A | | 4/1985 | Kawanami et al. |
| RE31,995 | E | | 10/1985 | Ball |
| 4,572,692 | A | | 2/1986 | Sauber |
| 4,619,497 | A | | 10/1986 | Vogel et al. |
| 4,633,359 | A | | 12/1986 | Mickelson et al. |
| 4,684,201 | A | | 8/1987 | Hutter |
| 4,718,854 | A | | 1/1988 | Capp et al. |
| 4,755,152 | A | | 7/1988 | Elliot et al. |
| 4,875,864 | A | | 10/1989 | Campbell |
| 4,915,651 | A | | 4/1990 | Bout |
| 4,990,106 | A | | 2/1991 | Szegda et al. |
| 5,011,432 | A | | 4/1991 | Sucht et al. |
| 5,041,020 | A | | 8/1991 | Michael |
| 5,073,129 | A | | 12/1991 | Szegda |
| 5,083,943 | A | | 1/1992 | Tarrant |
| 5,096,444 | A | | 3/1992 | Lu et al. |
| 5,123,863 | A | | 6/1992 | Frederick et al. |
| 5,141,448 | A | | 8/1992 | Mattingly et al. |
| 5,145,382 | A | | 9/1992 | Dickirson |
| 5,147,221 | A | | 9/1992 | Cull et al. |
| 5,161,993 | A | | 11/1992 | Leibfried |
| 5,195,905 | A | | 3/1993 | Pesci |
| 5,195,910 | A | | 3/1993 | Enomoto et al. |
| 5,198,958 | A | | 3/1993 | Krantz |
| 5,205,547 | A | | 4/1993 | Mattingly |
| 5,217,393 | A | | 6/1993 | Del Negro et al. |
| 5,237,293 | A | | 8/1993 | Kan et al. |
| 5,276,415 | A | | 1/1994 | Lewandowski et al. |
| 5,281,167 | A | | 1/1994 | Le et al. |
| 5,284,449 | A | | 2/1994 | Vaccaro |
| 5,295,864 | A | | 3/1994 | Birch et al. |
| 5,306,170 | A | | 4/1994 | Luu |
| 5,316,348 | A | | 5/1994 | Franklin |
| 5,318,458 | A | | 6/1994 | Thorner |
| 5,367,925 | A | | 11/1994 | Gasparre |
| 5,439,399 | A | | 8/1995 | Spechts et al. |
| 5,466,173 | A | | 11/1995 | Down |
| 5,470,257 | A | | 11/1995 | Szegda |
| 5,498,175 | A | | 3/1996 | Yeh et al. |
| 5,507,537 | A | | 4/1996 | Meisinger et al. |
| 5,525,076 | A | | 6/1996 | Down |
| 5,548,088 | A | | 8/1996 | Gray et al. |
| 5,564,938 | A | | 10/1996 | Shenkal et al. |
| 5,595,499 | A | | 1/1997 | Zander et al. |
| 5,607,325 | A | | 3/1997 | Toma |
| 5,632,633 | A | | 5/1997 | Roosdorp et al. |
| 5,632,651 | A | | 5/1997 | Szegda |
| 5,651,698 | A | | 7/1997 | Locati et al. |
| 5,660,565 | A | | 8/1997 | Williams |
| 5,667,409 | A | | 9/1997 | Wong et al. |
| 5,700,160 | A | | 12/1997 | Lee |
| 5,724,220 | A | | 3/1998 | Chaudhry |
| 5,730,622 | A | | 3/1998 | Olson |
| 5,829,992 | A | | 11/1998 | Merker et al. |
| 5,830,010 | A | | 11/1998 | Miskin et al. |
| 5,857,711 | A | | 1/1999 | Comin-DuMong et al. |
| 5,860,833 | A | | 1/1999 | Chillscyzn et al. |
| 5,863,226 | A | | 1/1999 | Lan et al. |
| 5,865,654 | A | | 2/1999 | Shimirak et al. |
| 5,882,233 | A | | 3/1999 | Idehara |
| 5,905,942 | A | | 5/1999 | Stoel et al. |
| 5,927,975 | A | | 7/1999 | Esrock |
| 5,938,465 | A | | 8/1999 | Fox, Sr. |
| 5,953,195 | A | | 9/1999 | Pagliuca |
| 5,984,378 | A | | 11/1999 | Ostrander et al. |
| 5,991,136 | A | | 11/1999 | Kaczmarek et al. |
| 6,010,349 | A | | 1/2000 | Porter |
| 6,011,218 | A | | 1/2000 | Burek et al. |
| 6,027,373 | A | | 2/2000 | Gray et al. |
| 6,042,422 | A | * | 3/2000 | Youtsey ..... 439/585 |
| 6,048,233 | A | | 4/2000 | Cole |
| 6,065,997 | A | | 5/2000 | Wang |
| 6,071,144 | A | | 6/2000 | Tang |
| 6,109,963 | A | | 8/2000 | Follingstad et al. |
| 6,113,431 | A | | 9/2000 | Wong |
| 6,140,582 | A | | 10/2000 | Sheehan |
| 6,142,788 | A | | 11/2000 | Han |
| 6,146,196 | A | | 11/2000 | Burger et al. |
| 6,174,206 | B1 | | 1/2001 | Yentile et al. |
| 6,183,297 | B1 | | 2/2001 | Kay et al. |
| 6,183,298 | B1 | | 2/2001 | Henningsen et al. |
| 6,210,221 | B1 | | 4/2001 | Maury |
| 6,210,222 | B1 | | 4/2001 | Langham et al. |
| 6,249,415 | B1 | | 6/2001 | Daoud et al. |
| 6,250,960 | B1 | | 6/2001 | Youtsey |
| 6,396,367 | B1 | | 5/2002 | Rosenberger |
| D459,306 | S | | 6/2002 | Malin |
| 6,425,782 | B1 | | 7/2002 | Holland |
| 6,450,836 | B1 | | 9/2002 | Youtsey |
| 6,468,100 | B1 | | 10/2002 | Meyer et al. |
| 6,591,055 | B1 | | 7/2003 | Eslambolchi et al. |
| 6,648,683 | B2 | | 11/2003 | Youtsey |
| 6,712,631 | B1 | | 3/2004 | Youtsey |
| 6,798,310 | B2 | | 9/2004 | Wong et al. |
| 6,877,996 | B1 | | 4/2005 | Franks, Jr. |
| D508,676 | S | | 8/2005 | Franks, Jr. |
| 7,131,868 | B2 | | 11/2006 | Montena |
| 7,144,273 | B1 | | 12/2006 | Chawgo |
| 7,147,509 | B1 | | 12/2006 | Burris et al. |
| 7,181,999 | B1 | | 2/2007 | Skeels et al. |
| 7,183,743 | B2 | | 2/2007 | Geiger |
| 7,198,495 | B1 | | 4/2007 | Youtsey |
| 7,306,484 | B1 | | 12/2007 | Mahoney et al. |
| 7,311,555 | B1 | | 12/2007 | Burris et al. |
| 7,347,129 | B1 | | 3/2008 | Youtsey |
| 7,404,737 | B1 | | 7/2008 | Youtsey |
| 7,500,874 | B2 | | 3/2009 | Montena |
| 7,513,795 | B1 | | 4/2009 | Shaw |
| 7,566,236 | B2 | * | 7/2009 | Malloy et al. ..... 439/321 |
| 7,635,283 | B1 | | 12/2009 | Islam |
| 7,785,144 | B1 | | 8/2010 | Islam |
| 7,837,501 | B2 | | 11/2010 | Youtsey |
| 7,841,912 | B2 | | 11/2010 | Hachadorian |
| 7,857,661 | B1 | | 12/2010 | Islam |
| 7,887,354 | B2 | * | 2/2011 | Holliday ..... 439/321 |
| 8,062,064 | B2 | | 11/2011 | Rodrigues et al. |
| 8,075,338 | B1 | * | 12/2011 | Montena ..... 439/578 |
| 8,079,860 | B1 | * | 12/2011 | Zraik ..... 439/255 |
| 8,113,875 | B2 | * | 2/2012 | Malloy et al. ..... 439/578 |
| 8,113,879 | B1 | * | 2/2012 | Zraik ..... 439/584 |
| 8,152,551 | B2 | * | 4/2012 | Zraik ..... 439/322 |

(56) References Cited

U.S. PATENT DOCUMENTS

| | | | | |
|---|---|---|---|---|
| 8,157,589 | B2 * | 4/2012 | Krenceski et al. | 439/578 |
| 8,206,176 | B2 | 6/2012 | Islam | |
| 2002/0090856 | A1 | 7/2002 | Weisz-Margulescu | |
| 2003/0046706 | A1 | 3/2003 | Rakib | |
| 2004/0048514 | A1 | 3/2004 | Kodaira | |
| 2004/0112356 | A1 | 6/2004 | Hatcher | |
| 2005/0148236 | A1 | 7/2005 | Montena | |
| 2005/0272311 | A1 | 12/2005 | Tsao | |
| 2006/0041922 | A1 | 2/2006 | Shapson | |
| 2006/0154522 | A1 | 7/2006 | Bernhart et al. | |
| 2006/0172571 | A1 | 8/2006 | Montena | |
| 2008/0311790 | A1 | 12/2008 | Malloy et al. | |
| 2008/0313691 | A1 | 12/2008 | Cholas et al. | |
| 2010/0297875 | A1 | 11/2010 | Purdy et al. | |
| 2011/0287653 | A1 | 11/2011 | Youtsey | |
| 2011/0318958 | A1 | 12/2011 | Burris et al. | |
| 2012/0045933 | A1 | 2/2012 | Youtsey | |
| 2012/0129387 | A1 | 5/2012 | Holland et al. | |
| 2012/0295464 | A1 | 11/2012 | Youtsey | |
| 2012/0295465 | A1 | 11/2012 | Youtsey | |
| 2012/0295466 | A1 | 11/2012 | Youtsey | |
| 2013/0143438 | A1 | 6/2013 | Wilson et al. | |

FOREIGN PATENT DOCUMENTS

| | | | |
|---|---|---|---|
| GB | 2079549 | A | 1/1982 |
| JP | 64002263 | A | 1/1989 |
| JP | 2299182 | | 12/1990 |
| JP | 05347170 | | 12/1993 |
| TW | 570415 | | 1/2004 |
| TW | I297633 | | 6/2008 |
| WO | 9310578 | | 5/1993 |
| WO | 2011146911 | | 11/2011 |
| WO | 2012158343 | A1 | 11/2012 |
| WO | 2012158344 | A1 | 11/2012 |
| WO | 2012158345 | A1 | 11/2012 |

OTHER PUBLICATIONS

"Pico/Macom GRB-I" and "Pico/Macom GRB-2" single and dual coax cable ground blocks, Stallions Satellite and Antenna—Grounding Products, dated Nov. 9, 2005 and printed Aug. 17, 2011, 3 pgs., located online at: http://web.archive.org/web/20051109024213/http://tvantenna.com/products/installation/grounding.html.

International Search Report and Written Opinion; PCT Application No. PCT/US2012/36065; Applicant: PCT International, Inc.; Date of Mailing: May 24, 2012, 8 pages.

Latest quality F-connector Supply Information, China Quality F Connector list, Hardware-Wholesale.com, printed on Jul. 9, 2008, 6 pages, located at: http://www.hardware-wholesale.com/buy-F_Connector/.

Non-Final Office Action for U.S. Appl. No. 13/111,807 dated Apr. 30, 2012, 12 pgs.

Examination Report for Taiwan Patent Application No. 101116284 dated May 21, 2014, 12 pages.

Rejection Decision for Taiwan Patent Application No. 101116284 dated Feb. 10, 2015, 5 pages.

Examination Report for Taiwan Patent Application No. 101116285 dated May 21, 2014, 12 pages.

Rejection Decision for Taiwan Patent Application No. 101116285 dated Feb. 13, 2015, 5 pages.

Examination Report for Taiwan Patent Application No. 101116286 dated May 21, 2014, 12 pages.

Rejection Decision for Taiwan Patent Application No. 101116286 dated Feb. 10, 2015, 5 pages.

* cited by examiner

COAXIAL CABLE CONNECTOR HAVING A COUPLING NUT AND A CONDUCTIVE INSERT WITH A FLANGE

CROSS REFERENCE TO RELATED APPLICATIONS

This International Application claims the benefit of International Application PCT/US2012/036065 filed May 2, 2012, which claims priority to U.S. application Ser. No. 13/111,807, filed May 19, 2011, the disclosures of which is are incorporated herein in their entireties by reference.

CROSS REFERENCE TO APPLICATIONS INCORPORATED BY REFERENCE

U.S. application Ser. No. 13/111,807, filed May 19, 2011, entitled "COAXIAL CONNECTOR; U.S. application Ser. No. 13/111,817, filed May 19, 2011, entitled "COAXIAL CONNECTOR WITH INTEGRATED LOCKING MEMBER"; and U.S. application Ser. No. 13/111,826, filed May 19, 2011, entitled "COAXIAL CONNECTOR WITH TORQUE WASHER", are incorporated herein in their entireties by reference.

TECHNICAL FIELD

The present invention relates to a coaxial connector that is resistant to loosening or separation (e.g. from vibration or thermal cycling) when coupled with a mating coaxial connector.

BACKGROUND

Screw-on, F-type connectors (or "F-connectors") are used on most radio frequency (RF) coaxial cables to interconnect TVs, cable TV decoders, VCR/DVD's, hard disk digital recorders, satellite receivers, and other devices. Male F-type connectors (sometimes called the "male connector" or "male F-connector") have a standardized design, generally using a 7/16 inch hex nut as a fastener. The nut has a relatively short (e.g., 1/8 to 1/4 inch) length and can be grasped by a person's fingers to be tightened or loosened.

In order to maintain a tight electrical connection, and to achieve the intended electrical performance, a male F-type connector must be securely tightened to an attachment structure (with respect to F-connectors, these attachment structures are sometimes called the "female connector" or "female F-connector"). However, a number of factors, including vibration and thermal cycling, can cause the male and female connectors to loosen and/or separate, resulting in signal loss or degradation of electrical performance. The present invention addresses these and other issues by helping to prevent the male and female F-type connectors from loosening or separating once engaged.

SUMMARY

The present invention helps prevent male and female F-type connectors from loosening or separating once engaged.

A coaxial connector (e.g., a male coaxial connector) of the present invention comprises a conductive insert and a coupling nut. The conductive insert has a front end with an annular flange. The coupling nut includes an inner surface defining a bore, wherein the bore at least partially surrounds the conductive insert and is configured to receive a provided male coaxial connector. The coupling nut further includes a locking member extending from its inner surface. The male connector further comprises a torque washer formed from fiber-reinforced rubber and disposed between the flange of the conductive insert and the locking member. When the coupling nut engages a corresponding female coaxial connector, the locking member and the torque washer are compressed against the flange of the insert. The compressed locking member and the compressed torque washer each maintain a tension force between the male and female connectors to help prevent separation of the male and female connectors. The male coaxial connector can be configured to be coupled to an end of the coaxial cable by, for example, crimping or compression.

Both the foregoing summary and the following detailed description are exemplary only and are not restrictive of the invention.

DETAILED DESCRIPTION

Figure 1A:
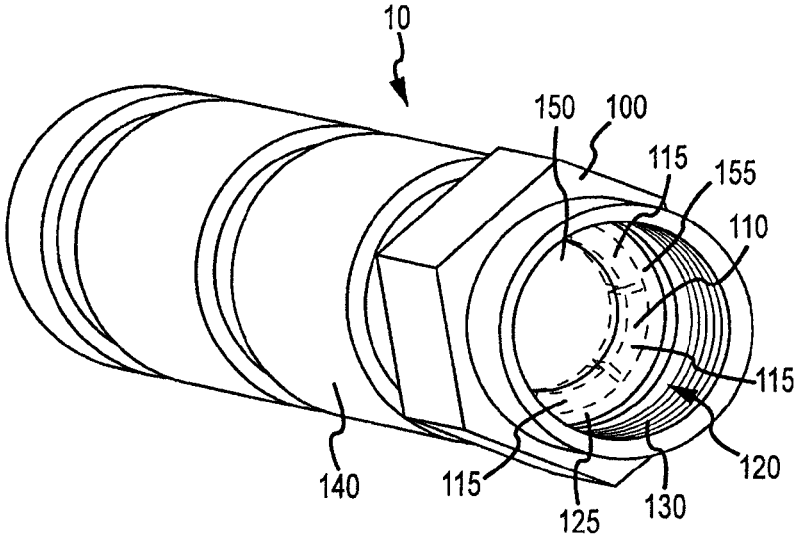
FIG. 1A is a perspective view of an exemplary male F-type coaxial connector according to aspects of the present invention.
Figure 1B:
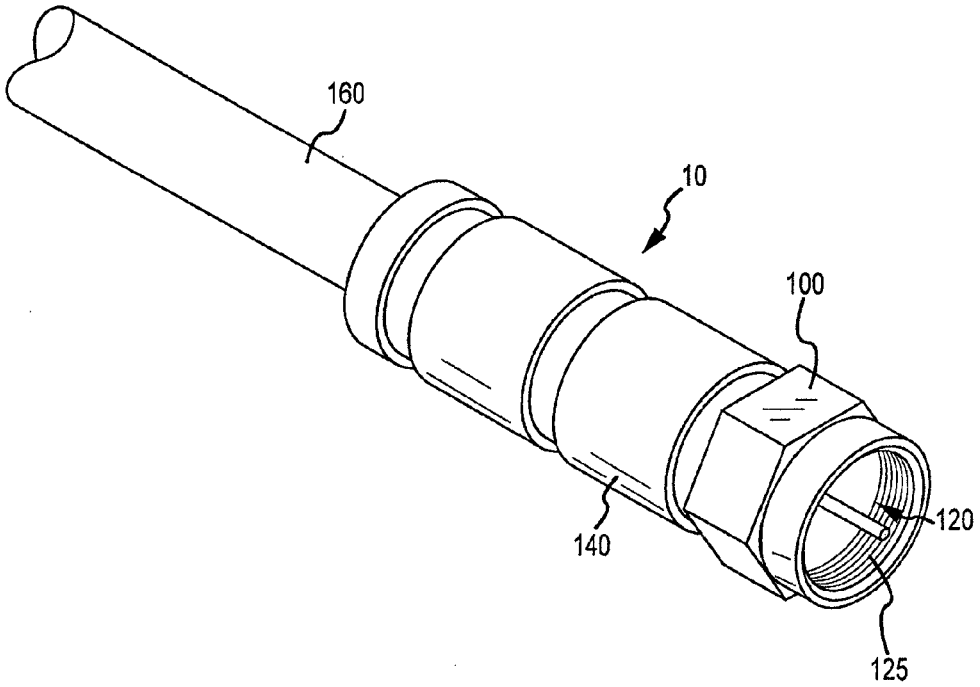
FIG. 1B is a perspective view of the connector of FIG. 1A coupled to a coaxial cable.
Figure 2:
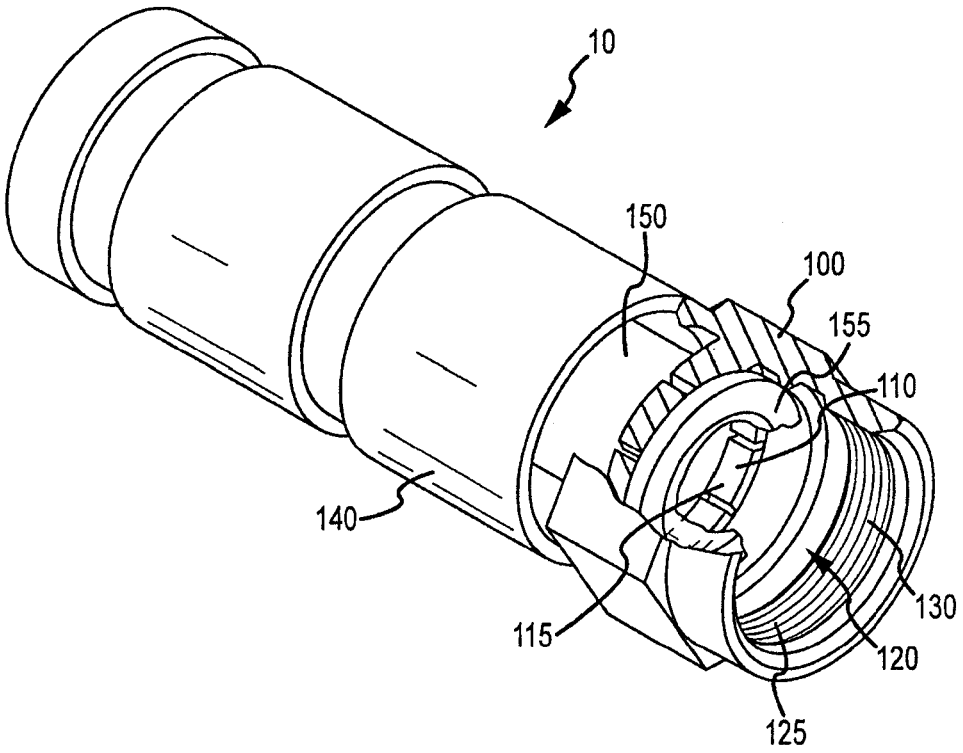
FIG. 2 is a perspective, cutaway view of the connector of FIG. 1A.

An exemplary coaxial connector 10 (e.g., a male F-connector 10) according to aspects of the present invention is depicted in FIGS. 1A, 1B, and 2. The connecter 10 is shown in FIG. 1B compressed onto the end of a coaxial cable 160. The connector 10 includes a coupling nut 100 that at least partially surrounds a conductive insert 150. The outer body 140 is juxtaposed the coupling nut 100 and retains the conductive insert 150. The coupling nut 100 includes an inner surface 125 defining a bore 120 through which a female F-type connector is received. At least a portion of the inner surface 125 includes threads 130 for engaging corresponding threads on the female F-type connector. The coupling nut includes a locking member 110 at the rear of the nut. When the male F-connector 10 is threaded onto the female F-connector, the locking member 110 is compressed against the conductive insert 150 and maintains a tension force between the male and female connectors to help prevent their separation from, for example, vibration and thermal cycling.

Figure 3:
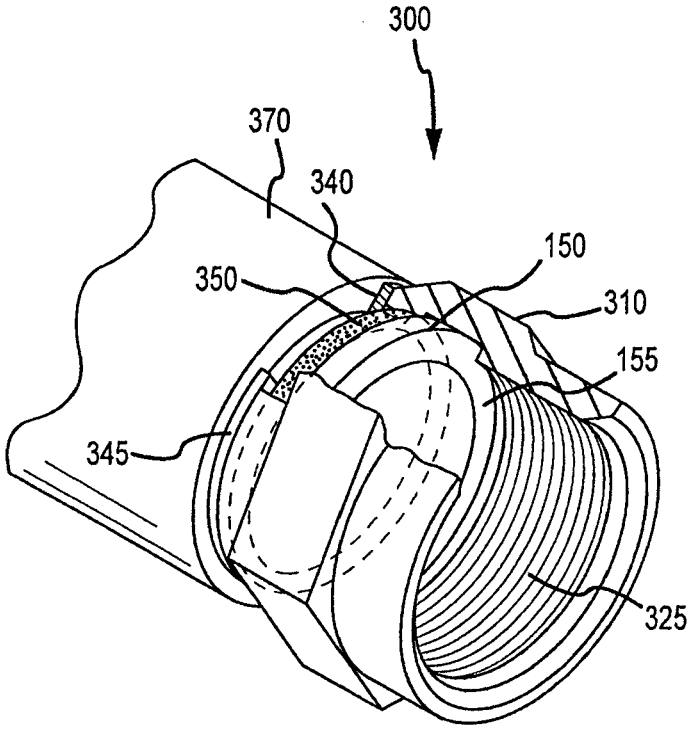
FIG. 3 is a perspective, cutaway view of another connector according to various aspects of the present invention.

FIG. 3 depicts another exemplary embodiment of a connector 300 according to the present invention. In this embodiment, the connector 300 includes a coupling nut 310 with an annular flange 340 extending from the inner surface 325 of the coupling nut 310. A shim washer 345 disposed between the coupling nut 310 and the outer body 370 of the connector 300 helps the coupling nut 310 and outer body 370 to rotate independently of each other. A torque washer 350 is disposed between the flange 340 of the coupling nut 310 and a flange 155 extending outwardly from the conductive insert 150. When the coupling nut 310 is threaded onto a female F-connector, the torque washer 350 is compressed between the flange 340 of the coupling nut 310 and the flange 155 of the conductive insert 150. The compressed torque washer 350 maintains a tension force between the male and female connectors to help prevent their separation during use.

Figure 4:
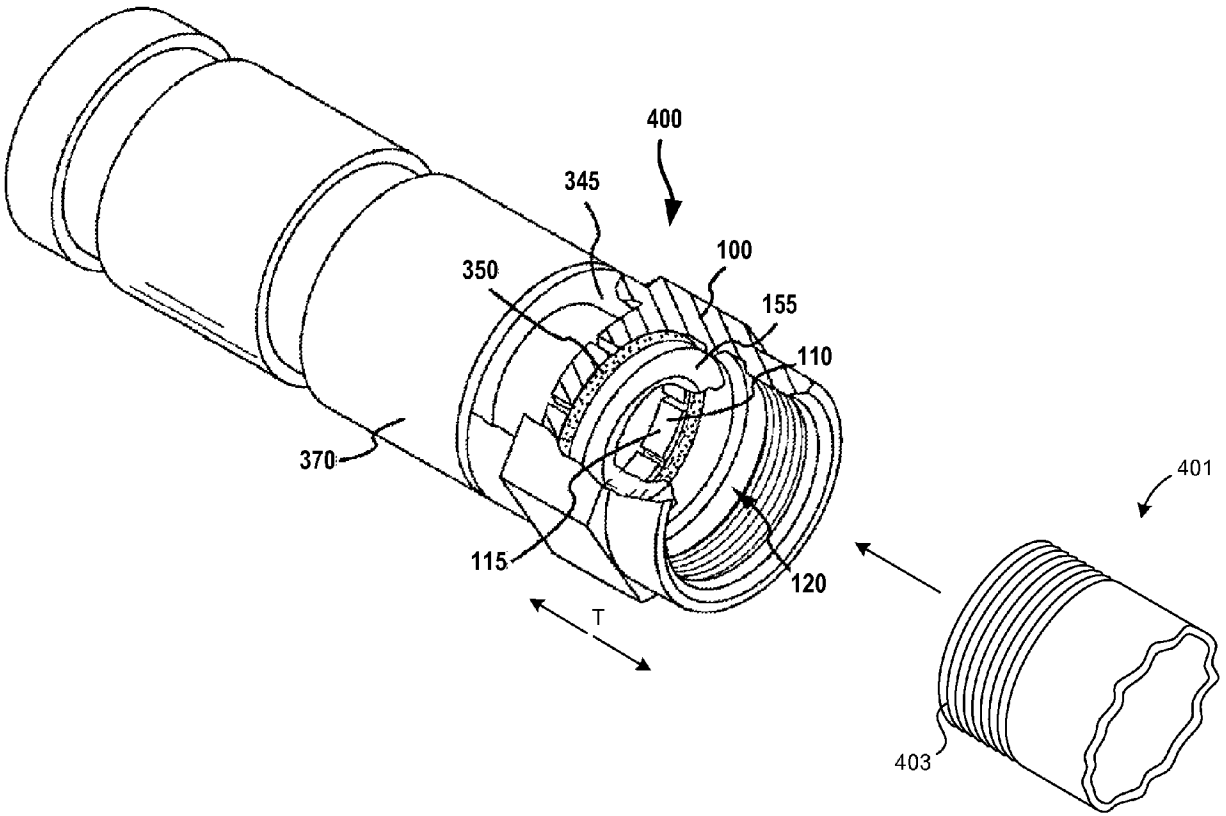
FIG. 4 is a perspective, cutaway view of another connector according to various aspects of the present invention.

FIG. 4 depicts yet another exemplary embodiment of a connector 400 according to the present invention. In this embodiment, connector 400 utilizes both a locking member 110 and torque washer 350 to help prevent separation of the male and female F-connectors after they are coupled together. In this embodiment, both the locking member 110 and the torque washer 350 are compressed against the flange 155 of the conductive insert 150 when the coupling nut 310 is threaded onto a plurality of threads 403 on a female F-connector 401. When compressed, the torque washer 350 and locking member 110 both maintain a tension force T between the male and female connectors to help prevent separation of the connectors during use.

The torque washer 350 may be any size, shape, thickness, and configuration, and may have any desired properties, to maintain a tension force between the male and female connectors. The torque washer 350 may be formed from any type (or types) of rubber, fiber-reinforced rubber, or equivalent materials. The rubber in the washer may include any suitable type of natural or synthetic rubber, including polychloroprene, nitrile, isoprene, acrylic, styrene-butadine, and combinations thereof. The torque washer 350 may be formed from rubber reinforced with woven and/or non-woven fibers. The fibers in the rubber may include natural or synthetic fibers, including cellulose, fiberglass, polyolefin, polyamide, polyester, polyimide, polyacrylic, and combinations thereof. The torque washer 350 is preferably formed from fiber-reinforced rubber having a relatively low compression set, high tensile strength, and high tear resistance.

In one exemplary embodiment of the present invention, the torque washer is formed from polychloreprene rubber (also known as NEOPRENE) having a classification by the American Society for Testing and Materials (ASTM) of ASTM D2000 BC, BE. In this embodiment, the polychorloprene rubber has a hardness of at least 85 durometer and is reinforced with two plys of 120 style, satin woven fiberglass fabric.

A connector of the present invention may be of any size, shape and configuration for use in conjunction with different sizes of coaxial cables. For example, smaller connectors may be used on smaller diameter cables (e.g., series 6 or 59 cable) while larger connectors are used with larger diameter cables (e.g., series 7 or 11 cable). The exemplary connector 10 (depicted in FIGS. 1 and 2) is a compression connector that is compressed longitudinally onto the end of a coaxial cable. Alternatively, the present invention may be utilized in conjunction with connectors that are axially crimped onto the end of a cable. An example of an axially-crimped connector is described in U.S. Pat. No. 6,042,422 to Timothy L. Youtsey, which is incorporated herein in its entirety by reference.

In the exemplary embodiment of the present invention depicted in FIGS. 1A, 1B, 2, and 4, the coupling nut 100 includes a locking member 110 proximal to the rear of the coupling nut 100. The coupling nut 100 receives a female F-type connector through the front of bore 120. The inner surface 125 of the coupling nut 100 includes threads 130 between the front of the coupling nut 100 and the locking member 110 to engage corresponding threads on the female F-connector.

The bore 120 of the coupling nut 100 at least partially surrounds a conductive insert 150, which includes an annular flange at its front end. The flange of the conductive insert 150 is disposed between the locking member 110 and the front of the coupling nut 100, while the body of the insert 150 extends through the rear of the coupling nut 100 and into the outer body 140. As the male F-connector 10 is threaded onto a female F-connector, the rear of the flange of the conductive insert 150 engages the front of the locking member 110, compressing the locking member and maintaining a tension force between the male and female F-connectors to help prevent their separation during use.

The locking member 110 extends from the inner surface 125 of the coupling nut 100. The locking member 110 may be any suitable size, shape and configuration to maintain a tension force between the male and female F-connectors when compressed by engagement of the male and female F-connectors. Forming the locking member 110 from the same material(s) as the rest of the coupling nut 100 can help make the coupling nut 100 easier and cheaper to produce. In one embodiment, for example, the coupling nut 100 (including the locking member 110) can be formed from a suitable metal material known in the art. Such materials can include, for example, brass (e.g., C3600 brass), copper, steel, stainless steel, aluminum, metalized composite plastic, etc. In alternate embodiments of the present invention, however, the locking member 110 may be formed from any number of desired materials, and need not necessarily be formed from the same material(s) as the rest of the coupling nut 100.

The locking member 110 may comprise one or more protrusions extending from the inner surface 125 of the coupling nut 100. A locking member of the present invention may include any number of protrusions of any size, shape, and configuration, and multiple protrusions of a locking member need not all be the same size, shape, or configuration.

Figure 5:
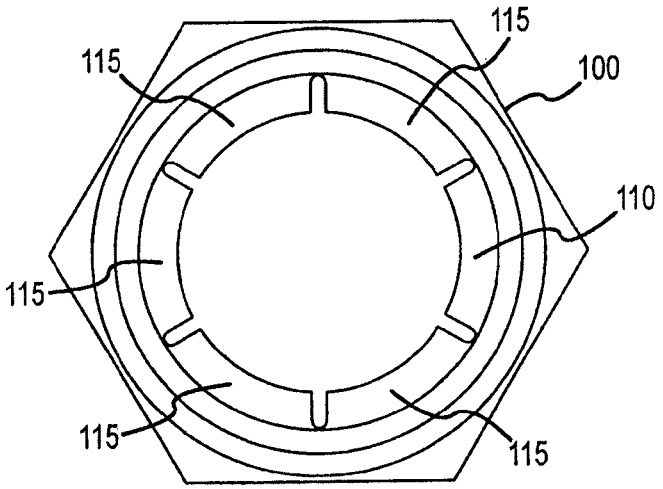
FIGS. 5-10 depict coupling nuts with different exemplary locking members according to various aspects of the present invention.
Figure 6:
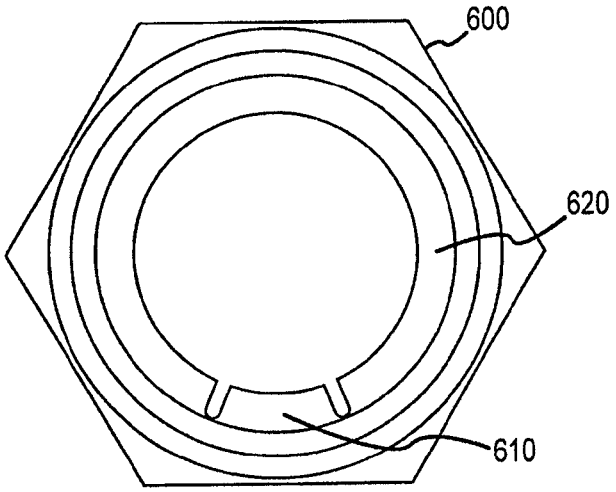
Figure 7A:
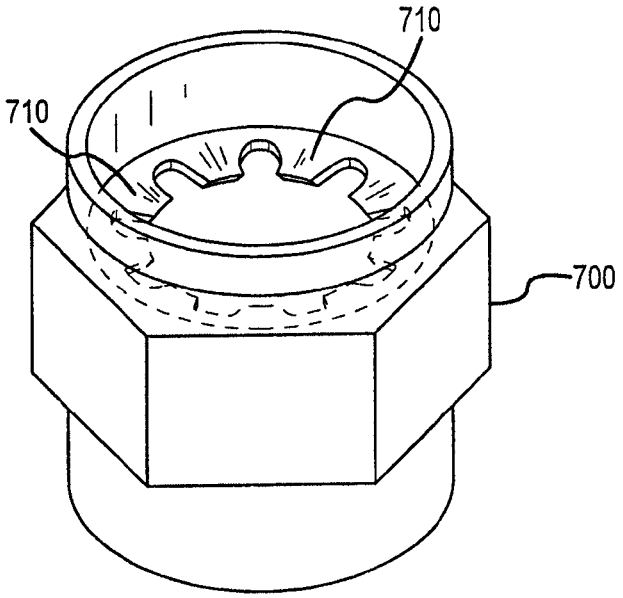
Figure 7B:
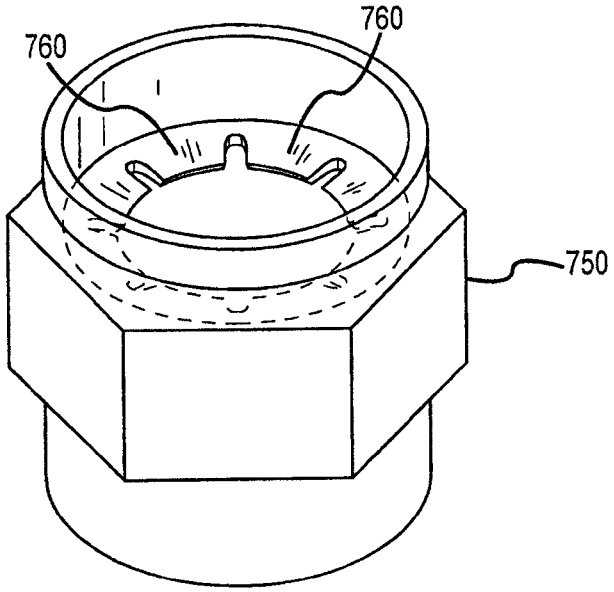

FIG. 5 illustrates a front view of the coupling nut 100 in FIGS. 1 and 2. In this exemplary embodiment, the locking member 110 includes six protrusions 115, each of which are approximately equal in circumferential length. The locking member 110 may include any number of protrusions of any size, shape, and configuration. In another exemplary embodiment, referring now to FIG. 6, coupling nut 600 includes a locking member having a first protrusion 610 and a second protrusion 620, where the second protrusion 620 is circumferentially longer than the first protrusion 610. In yet another exemplary embodiment, referring now to FIG. 7A, coupling nut 700 comprises nine protrusions 710. Each protrusion 710 is angled as shown to help provide and maintain a tension force between the male and female F-connectors when compressed. Similarly, referring to another exemplary embodiment in FIG. 7B, coupling nut 750 includes nine angled protrusions 760. Protrusions of a locking member of the present invention may be angled in any direction and in any desired manner.

Figure 8:
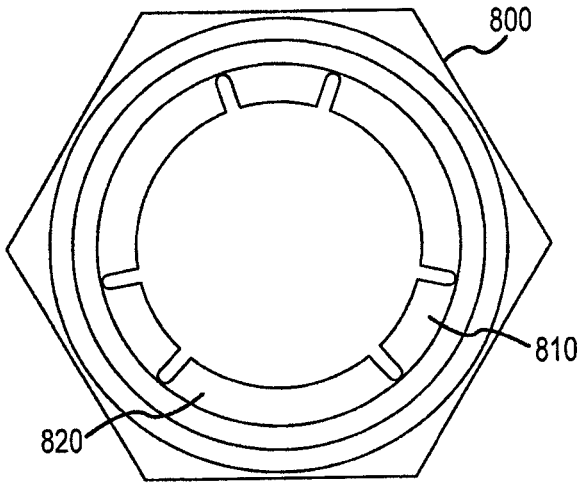
Figure 9:
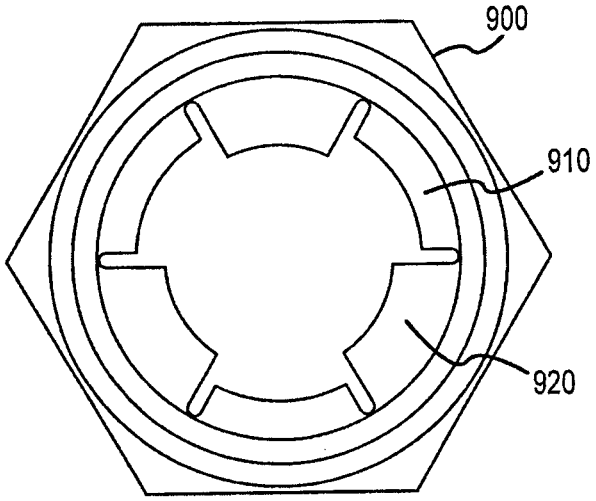
Figure 10:
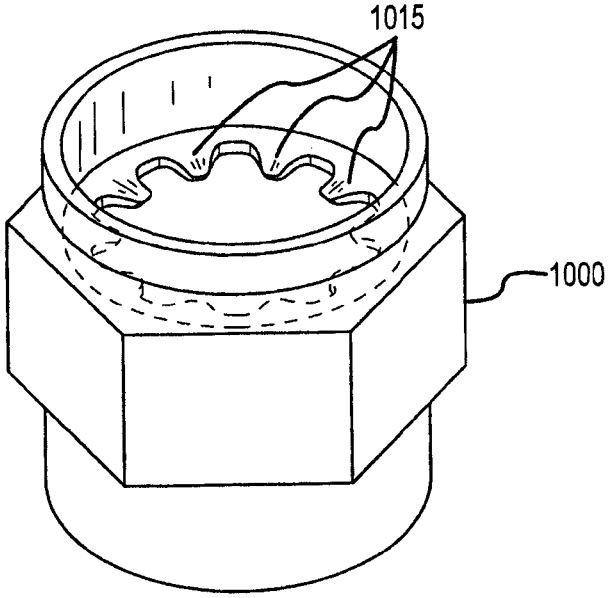

In FIG. 8, the locking member of coupling nut 800 comprises six protrusions, with circumferentially shorter protrusions 810 alternating with circumferentially longer protrusions 820. The protrusions 810, 820 are spaced such that the shorter protrusions 810 are disposed opposite from the longer protrusions 820. In FIG. 9, coupling nut 900 includes a locking member with six protrusions, where protrusions 920 extend farther from the inner surface of the coupling nut 900 than protrusions 910. In yet another exemplary embodiment, referring to FIG. 10, coupling nut 1000 includes a locking member with ten saw-tooth protrusions 1015.

The particular implementations shown and described above are illustrative of the invention and its best mode and are not intended to limit the scope of the invention in any way. Methods illustrated in the various figures may include more, fewer, or other steps. Additionally, steps may be performed in any suitable order without departing from the scope of the invention. Changes and modifications may be made to the disclosed embodiments without departing from the scope of the present invention. These and other changes or modifications are intended to be included within the scope of the present invention, as expressed in the appended claims.

I claim:

1. A male coaxial cable connector comprising:

(a) a conductive insert having a front end and an annular flange extending outwardly from the front end;

(b) a coupling nut including (1) an inner surface defining a bore, the bore at least partially surrounding the conductive insert, wherein the bore is configured to receive a female coaxial cable connector; and (2) a locking member having a plurality of protrusions extending inwardly from the inner surface of the coupling nut; and (c) a torque washer disposed between the annular flange of the conductive insert and the locking member, whereby when the coupling nut engages the female coaxial cable connector, the locking member and the torque washer are compressed against the annular flange of the conductive insert, and wherein the compressed locking member and the compressed torque washer each maintain a tension force between the male and female coaxial cable connectors to help prevent separation of the male and female coaxial cable connectors.

2. The male coaxial cable connector of claim 1, wherein the coupling nut has a front end and a rear end, wherein the locking member is proximal to the rear end of the coupling nut, and wherein the female coaxial cable connector is received in the bore at the front end of the coupling nut.

3. The male coaxial cable connector of claim 2, wherein the inner surface is at least partially threaded between the front end of the coupling nut and the locking member to engage threads on the provided female coaxial cable connector.

4. The male coaxial cable connector of claim 2, wherein the annular flange of the conductive insert is disposed between the locking member and the front end of the coupling nut.

5. The male coaxial cable connector of claim 1, further comprising an outer body configured to retain the conductive insert, the outer body juxtaposed the rear end of the coupling nut.

6. The male coaxial cable connector of claim 1, wherein the plurality of protrusions includes a first protrusion and a second protrusion, and wherein the second protrusion is circumferentially longer than the first protrusion.

7. The male coaxial cable connector of claim 1, wherein the plurality of protrusions includes a first protrusion and a second protrusion, the first protrusion extending a first distance from the inner surface of the coupling nut, and the second protrusion extending a second distance, greater than the first distance, from the inner surface of the coupling nut.

8. The male coaxial cable connector of claim 1, wherein the plurality of protrusions includes:

a first protrusion having a first circumferential length;

a second protrusion opposite the first protrusion, wherein the second protrusion has a second circumferential length different than the first circumferential length;

a third protrusion having a circumferential length approximately equal to the first circumferential length; and a fourth protrusion opposite the third protrusion, wherein the fourth protrusion has a circumferential length approximately equal to the second circumferential length.

9. The male coaxial cable connector of claim 8, wherein the plurality of protrusions further includes:

a fifth protrusion of approximately equal circumferential length as the first protrusion; and a sixth protrusion opposite the fifth protrusion, the sixth protrusion of approximately equal circumferential length as the second protrusion.

10. The male coaxial cable connector of claim 1, wherein at least a portion of one or more of the plurality of protrusions are angled toward at least one of: a front end of the coupling nut and a rear end of the coupling nut.

11. The male coaxial cable connector of claim 1, wherein the torque washer comprises a fiber-reinforced rubber.

12. The male coaxial cable connector of claim 1, wherein the torque washer comprises a rubber reinforced with woven fibers.

13. The male coaxial cable connector of claim 12, wherein the woven fibers include fibers comprising one or more of:

cellulose;
fiberglass;
polyolefin;
polyamide;
polyester;
polyimide;
polyacrylic; and
combinations thereof.

14. The male coaxial cable connector of claim 1, wherein the torque washer comprises a rubber reinforced with non-woven fibers.

15. The male coaxial cable connector of claim 14, wherein the non-woven fibers include fibers comprising one or more of:

cellulose;
fiberglass;
polyolefin;
polyamide;
polyester;
polyimide;
polyacrylic; and
combinations thereof.

16. The male coaxial cable connector of claim 1, wherein the torque washer comprises a rubber selected from the group of:

polychloroprene;
nitrile;
isoprene;
acrylic;
styrene-butadine; and
combinations thereof.

17. The male coaxial cable connector of claim 1, wherein the torque washer has a hardness of at least 85 durometer.

18. A system comprising:

(a) a coaxial cable having an end portion; and (b) a male coaxial cable connector coupled to the end portion of the coaxial cable, wherein the male coaxial cable connector includes (1) a conductive insert having a front end and having an annular flange extending outwardly from the front end;

(2) a coupling nut having a front end and a rear end, wherein the coupling nut further includes (i) an inner surface defining a bore, the bore at least partially surrounding the conductive insert wherein the bore is configured to receive a female coaxial cable connector; and (ii) a locking member having a plurality of protrusions extending from the inner surface of the coupling nut, wherein at least a portion of one or more of the plurality of protrusions is angled toward at least one of the front end of the coupling nut and the rear end of the coupling nut; and (3) a torque washer disposed between the annular flange of the conductive insert and the locking member, whereby when the coupling nut engages the female coaxial cable connector, the locking member and the torque washer are compressed against the annular flange of the conductive insert, and wherein the compressed locking member and the compressed torque washer each maintain a tension force between the male and female connectors to help prevent separation of the male and female connectors.

19. The system of claim 18, wherein the locking member is proximal to the rear end of the coupling nut, and wherein the female coaxial cable connector is received in the bore at the front end of the coupling nut.

20. The system of claim 19, wherein the inner surface of the coupling nut is at least partially threaded between the front end of the coupling nut and the locking member to engage threads on the female coaxial cable connector.

21. The system of claim 19, wherein the annular flange of the conductive insert is disposed between the locking member and the front end of the coupling nut.

22. The system of claim 19, further comprising an outer body configured to retain the conductive insert, the outer body juxtaposed the rear end of the coupling nut.

23. The system of claim 18, wherein the plurality of protrusions includes a first protrusion and a second protrusion, the second protrusion circumferentially longer than the first protrusion.

24. The system of claim 18, wherein the plurality of protrusions includes a first protrusion and a second protrusion, the first protrusion extending a first distance from the inner surface of the coupling nut, and the second protrusion extending a second distance, greater than the first distance, from the inner surface of the coupling nut.

25. The system of claim 18, wherein the plurality of protrusions includes:

a first protrusion having a first circumferential length;

a second protrusion radially opposite the first protrusion, wherein the second protrusion has a second circumferential length different than the first circumferential length;

a third protrusion having a circumferential length approximately equal to the first circumferential length; and a fourth protrusion radially opposite the third protrusion, wherein the fourth protrusion has a circumferential length approximately equal to the second circumferential length.

26. The system of claim 25, wherein the plurality of protrusions further includes:

a fifth protrusion of approximately equal circumferential length as the first protrusion; and a sixth protrusion opposite the fifth protrusion, the sixth protrusion of approximately equal circumferential length as the second protrusion.

27. The system of claim 18, wherein the torque washer comprises a rubber.

28. The system of claim 18, wherein the torque washer comprises a rubber reinforced with woven fibers.

29. The system of claim 28, wherein the woven fibers include fibers comprising one or more of:

cellulose;
fiberglass;
polyolefin;
polyamide;
polyester;
polyimide;
polyacrylic; and
combinations thereof.

30. The system of claim 18, wherein the torque washer comprises a rubber reinforced with non-woven fibers.

31. The system of claim 30, wherein the non-woven fibers include fibers comprising one or more of:

cellulose;
fiberglass;
polyolefin;
polyamide;
polyester;
polyimide;
polyacrylic; and
combinations thereof.

32. The system of claim 18, wherein the torque washer comprises a rubber selected from the group of:

polychloroprene;
nitrile;
isoprene;
acrylic;
styrene-butadine; and
combinations thereof.

33. The system of claim 18, wherein the torque washer has a hardness of at least 85 durometer.

34. A male coaxial cable connector comprising:

a conductive insert having a front end and an annular flange extending outwardly from the front end; and a coupling nut that includes an inner surface defining a bore, the bore at least partially surrounding the conductive insert and configured to receive a female coaxial cable connector; and a locking member extending from the inner surface, whereby when the coupling nut engages the female coaxial cable connector, the locking member is compressed against the annular flange of the conductive insert and maintains a tension force between the male and female connectors to help prevent separation of the male and female connectors.

35. The male coaxial cable connector of claim 34, wherein the coupling nut has a front end and a rear end, wherein the locking member is proximal to the rear end of the coupling nut, and wherein the female coaxial cable connector is received in the bore at the front end of the coupling nut.

36. The male coaxial cable connector of claim 35, wherein the inner surface of the coupling nut is at least partially threaded between the front end of the coupling nut and the locking member, and wherein the threads are configured to engage threads on the female coaxial cable connector.

37. The male coaxial cable connector of claim 35, wherein the annular flange of the conductive insert is disposed between the locking member and the front end of the coupling nut.

38. The male coaxial cable connector of claim 34, further comprising an outer body configured to retain the conductive insert the outer body juxtaposed the rear end of the coupling nut.

39. The male coaxial cable connector of claim 34, wherein the locking member comprises a plurality of protrusions extending from the inner surface of the coupling nut.

40. The connector of claim 39, wherein the plurality of protrusions includes a first protrusion and a second protrusion, the second protrusion circumferentially longer than the first protrusion.

41. The male coaxial cable connector of claim 39, wherein the plurality of protrusions includes a first protrusion and a second protrusion, the first protrusion extending a first distance from the inner surface of the coupling nut, and the second protrusion extending a second distance, different than the first distance, from the inner surface of the coupling nut.

42. The male coaxial cable connector of claim 39, wherein the plurality of protrusions includes:

a first protrusion having a first circumferential length;

a second protrusion opposite the first protrusion, wherein the second protrusion has a second circumferential length different than the first circumferential length;

a third protrusion having a circumferential length approximately equal to the first circumferential length; and a fourth protrusion opposite the third protrusion, wherein the fourth protrusion has a circumferential length approximately equal to the second circumferential length.

43. The male coaxial cable connector of claim 42, wherein the plurality of protrusions further includes:

a fifth protrusion of approximately equal circumferential length as the first protrusion; and a sixth protrusion opposite the fifth protrusion, the sixth protrusion of approximately equal circumferential length as the second protrusion.

44. The male coaxial cable connector of claim 39, wherein at least a portion of one or more of the plurality of protrusions are angled toward at least one of: a front end of the coupling nut and a rear end of the coupling nut.

45. A male coaxial cable connector comprising:

a conductive insert including a front end and an annular flange extending outwardly from the front end; and a coupling nut that includes an inner surface defining a bore, the bore at least partially surrounding the conductive insert and configured to receive a female coaxial cable connector;

an annular flange including a plurality of protrusions extending from the inner surface, wherein the plurality of protrusions includes a first protrusion and at least a second protrusion, and wherein the first and second protrusions have different circumferential lengths; and a torque washer disposed between the annular flange of the conductive insert and the annular flange of the coupling nut, whereby when the coupling nut engages the female coaxial cable connector, the torque washer is compressed between the annular flange of the coupling nut and the annular flange of the insert and maintains a tension force between the male and female connectors to help prevent separation of the male and female connectors.

46. The male coaxial cable connector of claim 45 wherein at least a portion of the inner surface is threaded to engage threads on the female coaxial cable connector.

47. The male coaxial cable connector of claim 45, further comprising an outer body configured to retain the rear end of the conductive insert, the outer body juxtaposed the coupling nut.

48. The male coaxial cable connector of claim 47, further comprising a washer disposed between the coupling nut and the outer body, wherein the washer is configured to facilitate independent rotation of the outer body and the coupling nut.

49. The male coaxial cable connector of claim 45, wherein the first protrusion extends a first distance from the inner surface of the coupling nut, and wherein the second protrusion extends a second distance, different than the first radial distance, from the inner surface of the coupling nut.

50. The male coaxial cable connector of claim 45, wherein the first and second protrusions have corresponding first and second circumferential lengths, and wherein the plurality of protrusions further includes:

a third protrusion having a circumferential length approximately equal to the first circumferential length; and a fourth protrusion opposite the third protrusion, wherein the fourth protrusion has a circumferential length approximately equal to the second circumferential length.

51. The male coaxial cable connector of claim 50, wherein the plurality of protrusions further includes:

a fifth protrusion; and a sixth protrusion opposite the fifth protrusion, wherein the fifth and sixth protrusions have different circumferential lengths.

52. The male coaxial cable connector of claim 45, wherein coupling nut has a front end and a rear end, and wherein at least one of the plurality of protrusions is angled toward the front end of the coupling nut.

53. The male coaxial cable connector of claim 45, wherein coupling nut has a front end and a rear end, and wherein at least one of the plurality of protrusions is angled toward the rear end of the coupling nut.

54. The male coaxial cable connector of claim 45, wherein the plurality of protrusions comprises at least one protrusion having a saw-tooth shape.

* * * * *

UNITED STATES PATENT AND TRADEMARK OFFICE

CERTIFICATE OF CORRECTION

PATENT NO. : 9,240,636 B2
APPLICATION NO. : 14/118198
DATED : January 19, 2016
INVENTOR(S) : Timothy Lee Youtsey It is certified that error appears in the above-identified patent and that said Letters Patent is hereby corrected as shown below:

Specification

In column 1, line 8, after “This” delete “International”.

In column 1, line 11, after “which” delete “is”.

In column 1, line 18, delete “CONNECTOR;” and insert -- CONNECTOR”; --, therefor.

In column 3, line 25, delete “styrene-butadine,” and insert -- styrene-butadiene, --, therefor.

In column 3, line 35, delete “polychloreprene” and insert -- polychloroprene --, therefor.

In column 3, line 38, delete “polychorloprene” and insert -- polychloroprene --, therefor.

Claims

In column 6, line 48, in claim 16, delete “styrene-butadine;” and insert -- styrene-butadiene; --, therefor.

In column 6, line 57, in claim 18, delete “and having” and insert -- and --, therefor.

In column 8, line 25, in claim 32, delete “styrene-butadine;” and insert -- styrene-butadiene; --, therefor.

Signed and Sealed this
Twenty-sixth Day of April, 2016

Michelle K. Lee

Michelle K. Lee
*Director of the United States Patent and Trademark Office*